US009697669B2

(12) United States Patent
Terzini

(10) Patent No.: US 9,697,669 B2
(45) Date of Patent: Jul. 4, 2017

(54) ADJUSTABLE PRODUCT MAGAZINE SLEEVE

(71) Applicant: Tension International, Inc., Kansas City, MO (US)

(72) Inventor: Robert Terzini, Corinth, TX (US)

(73) Assignee: Tension International, Inc., Kansas City, MO (US)

( * ) Notice: Subject to any disclaimer, the term of this patent is extended or adjusted under 35 U.S.C. 154(b) by 386 days.

(21) Appl. No.: 14/063,657

(22) Filed: Oct. 25, 2013

(65) Prior Publication Data

US 2014/0117037 A1 May 1, 2014

Related U.S. Application Data

(60) Provisional application No. 61/718,565, filed on Oct. 25, 2012.

(51) Int. Cl.
*G07F 11/04* (2006.01)
*G07F 11/00* (2006.01)

(52) U.S. Cl.
CPC ..... *G07F 11/04* (2013.01); *G07F 11/007* (2013.01)

(58) Field of Classification Search
CPC ..... G07F 11/04; G07F 11/007
See application file for complete search history.

(56) References Cited

U.S. PATENT DOCUMENTS 5,127,546 A * 7/1992 Chen ..... G07F 11/007 221/203
5,316,154 A * 5/1994 Hajec, Jr. ..... A47F 1/08 211/59.2
5,799,824 A * 9/1998 Gasiel ..... G07F 11/16 221/112
D478,737 S * 8/2003 Sparkowski ..... D6/518
6,955,268 B2 * 10/2005 Waldron ..... A47F 7/145 211/194
7,100,795 B2 * 9/2006 Kelly ..... G07F 11/007 221/131

* cited by examiner

*Primary Examiner* — Gene Crawford
*Assistant Examiner* — Kelvin L Randall, Jr.
(74) *Attorney, Agent, or Firm* — Polsinelli PC; Marcia J. Rodgers

(57) ABSTRACT

A removable, adjustable product magazine for use in an article dispensing system includes a central support member including a back wall connected to a base, first and second sidewalls, and a follower. The central support and the sidewalls cooperatively define a product compartment having a front opening. The sidewalls include fastener slots for connecting the follower to one of the sidewalls. Advancement of the follower adjusts the depth of the compartment. Each of the sidewalls has front, rear, and bottom flanges for retaining products within the magazine, connecting the sidewalls to the back wall and base. The base and backwall have fastener slots for adjustable connection of the sidewalls, thereby enabling adjustment of the width of the compartment. The sidewall front flanges terminate above the base to provide a product exit port. The back wall includes an ejector port for providing access to an ejector cylinder to expel product units.

9 Claims, 9 Drawing Sheets

ADJUSTABLE PRODUCT MAGAZINE SLEEVE

FIELD

The present disclosure generally relates to a product magazine for an article dispensing system. More particularly, it concerns a sleeve that can be adjusted to accommodate articles of varying sizes and shapes for loading and supplying the articles to an automated product dispensing system.

BACKGROUND

Automated and semi-automated product dispensing systems for small objects, such as pharmaceuticals and the like, include one or more magazines or cartridges that temporarily store vertical stacks of products within the dispensing unit. Products are dispensed one at a time from the bottom of each stack, generally into a tote or into a "print and apply" labeling device and then dropped into a tote or other container that transports the product through the system. Along the way, other products from the same or other dispensing units may be added to the original product until the customer order has been filled. Each product as well as the entire order is tagged or labeled by a bar code, radio frequency identification device (RFID) or other method that is scanned or read at multiple points in the system to verify progress and accuracy. If the product is not rejected, it is ultimately routed to an order dispensing station, where it is exported from the dispensing system, either alone or in combination with other products that comprise a customer order.

Products to be dispensed are generally, though not always, supplied in containers. The products or containers are barcoded, RFID tagged or otherwise identified and are generally scanned by an operator as the product is loaded into the magazine. The products may also be scanned during temporary storage within the magazine. For the latter type of scanning it is desirable that all of the products are placed in the magazine in the same predetermined orientation to enable their bar codes, RFID tags, or other indicia to be scanned by a unit positioned outside the magazine. Such scanning is used to verify that the magazine has been loaded with the correct product, that the product has been dispensed, and to track the product as it passes through the system to ensure that it is packaged along with other products specified in a customer order, and to ensure that the product ultimately exits the system.

Current automatic and semi-automatic dispensing units are provided with a requisite number of identically sized and shaped product magazines or sleeves that form vertical columns when installed on or in the dispensing unit. These magazine sleeves generally have a rectangular longitudinal cross section to accommodate elongated product packages such as tubes, boxes and bottles. Each product sleeve may be preloaded with a quantity of a preselected product and is then installed in a selected dispensing unit. Alternatively, the sleeve may be installed in a selected dispensing unit and then loaded with a quantity of a preselected product. It is also foreseen that more than one type of product may be loaded into the sleeve in a predetermined order, either before or after installation in a dispensing unit. The external dimensions of the magazines are uniformly sized for interchangeable reception in the dispensing unit. In order to avoid the expense of multiple sets of magazines, the interior dimensions are sized for reception of the largest product or container likely to be handled by the dispensing unit. However, many dispensable products are actually substantially smaller than the maximum allowable size. In addition, some products present an irregular shape. Smaller and irregularly shaped products tend to form an irregular vertical stack within the magazine sleeve, in which some products stack in contact with one wall, other products stack in contact with the opposite wall, and some products may contact none of the walls. This arrangement can cause the products to "bunch" up within the magazine sleeve and create irregular spaces. Such irregular spacing between products can affect the speed at which the products drop from the bottom of the stack, leading to uneven discharge of the products. It can also cause jams that halt product discharge entirely and necessitate operator intervention to reorient the products within the sleeve. Where the dispensing system includes multiple dispensing units, more than one of which may contribute to the fulfillment of a single customer order, it may also be necessary to stop the operation of other dispensing units in the system until the jam in the affected unit can be cleared.

While product sleeves could be constructed to correspond with various sized articles, the wide variety of sizes and shapes of small objects that are currently dispensed by such automated and semi-automated units renders such a solution cost-prohibitive.

Accordingly, there is a need for a product magazine for automated and semi-automated article dispensing systems that can be adjusted to accommodate the size and shape of the articles being dispensed and subsequently readjusted to accommodate articles having a different size and/or shape, that can orient the product in a longitudinally oriented or vertical opening in the sleeve to enable scanning, that can be easily, quickly, and repeatedly adjusted and readjusted, and that minimizes bunching and jamming of products within the magazine and the concomitant need for operator intervention.

SUMMARY

The present disclosure provides a greatly improved adjustable product magazine sleeve for use in an article dispensing system. The product sleeve includes a central support member including a back wall connected to a base, first and second opposed sidewalls, and a follower structure. The central support member and the sidewalls cooperatively define a product compartment having a front opening. The sidewalls include substantially transverse slots for adjustably receiving a fastener connecting the follower to one of the sidewalls. Advancement of the follower effectively adjusts the depth of the compartment by urging the products toward the front opening of the compartment. Each of the sidewalls has front, rear, and bottom flanges for respectively retaining products within the magazine, connecting the sidewall to the back wall, and connecting the sidewall to the base. The base has spaced, substantially transverse slots for adjustably receiving fasteners that connect the sidewall bottom flanges to the base and the back wall has spaced substantially transverse slots for adjustably positioning fasteners that connect the sidewall rear flanges to the back wall, thereby enabling adjustment of the width of the compartment.

The sidewall bottom flanges and base may be connected or clamped together with an optional fastener or clamp bar to provide strength and support. A single fastener bar may be provided, or a pair of clamp bars may be provided, each connecting or clamping a sidewall bottom flange to the base.

The sidewall front flanges may terminate at a spaced distance above the base to provide a product exit port. The sidewall rear flanges and the follower may include integral fasteners. The base and the back wall may be interconnected, or they may be of unitary construction. The base may include a sensor port for determining whether the sleeve is empty or contains one or more products. The back wall may include an ejector port for providing access to an ejector cylinder to expel product units. In one embodiment, the base, back wall and sidewalls are each equipped with a single transverse slot. In another embodiment, a pair of followers is provided.

A method of operation of an adjustable product magazine or sleeve involves moving the sidewalls to a selected, spaced-apart position by sliding the fasteners in the base and back wall slots until the central support member back wall and base and the sidewalls form a product compartment having a desired width, securing the fasteners, moving the follower by sliding the follower fastener in the sidewall slots to form a product compartment having a desired length, and securing the fastener, and reversing the steps to enlarge the size of the product compartment. The product magazine is removable from the dispensing system, and may be loaded with products before installation in the dispensing system, or it may be installed in the dispensing system and then loaded with products.

Various objects, features and advantages of this disclosure will become apparent from the following detailed description, which, taken in conjunction with the accompanying drawings, which depict, by way of illustration and example, certain embodiments of this adjustable product magazine sleeve.

The drawings constitute a part of this specification, include exemplary embodiments of the adjustable product sleeve, and illustrate various objects and features thereof.

DETAILED DESCRIPTION

As required, detailed embodiments of the adjustable product sleeve are disclosed herein. However, the disclosed embodiments are provided for illustration only and are merely exemplary of the device, which may be embodied in various forms. Therefore, specific structural and functional details disclosed herein are not to be interpreted as limiting, but merely as a basis for the claims and as a representative basis for teaching one skilled in the art to variously employ the apparatus in virtually any appropriately detailed structure.

Figure 1:
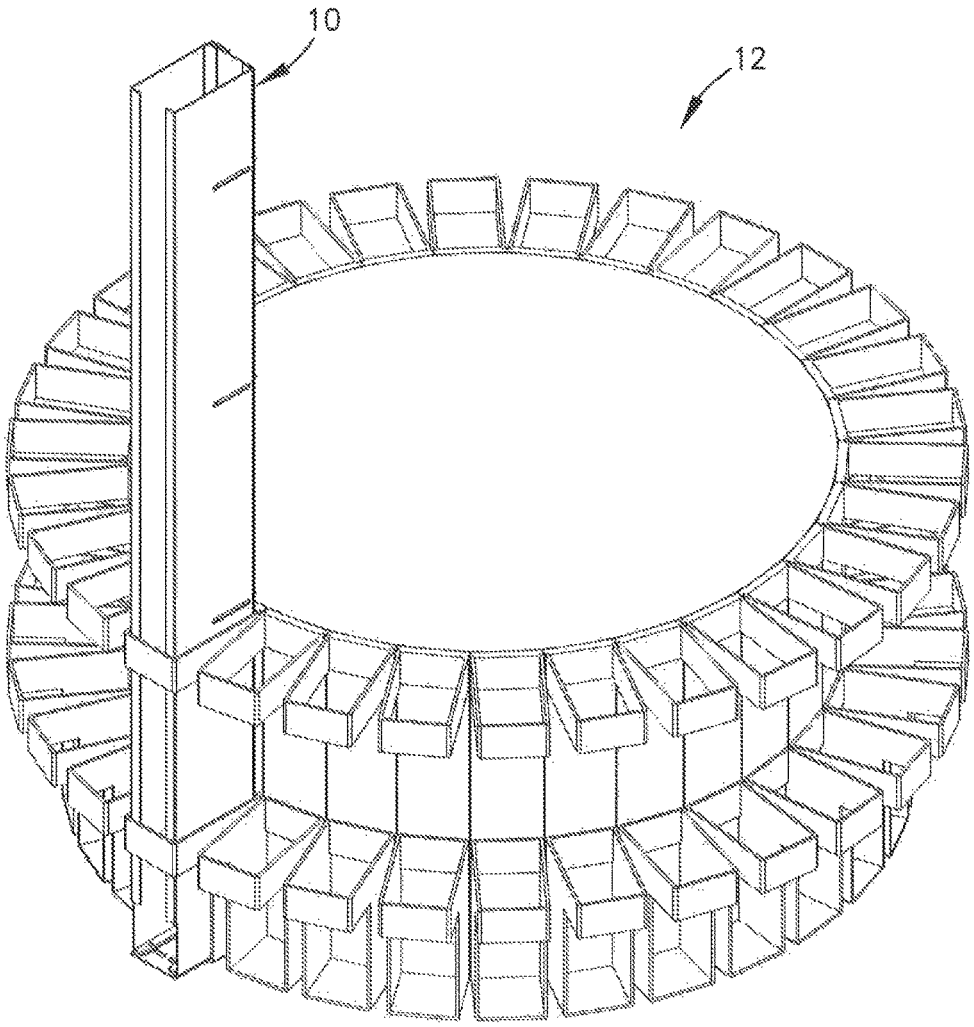
FIG. 1 is a perspective view of an adjustable product sleeve installed in a rotary product dispensing unit.
Figure 2:
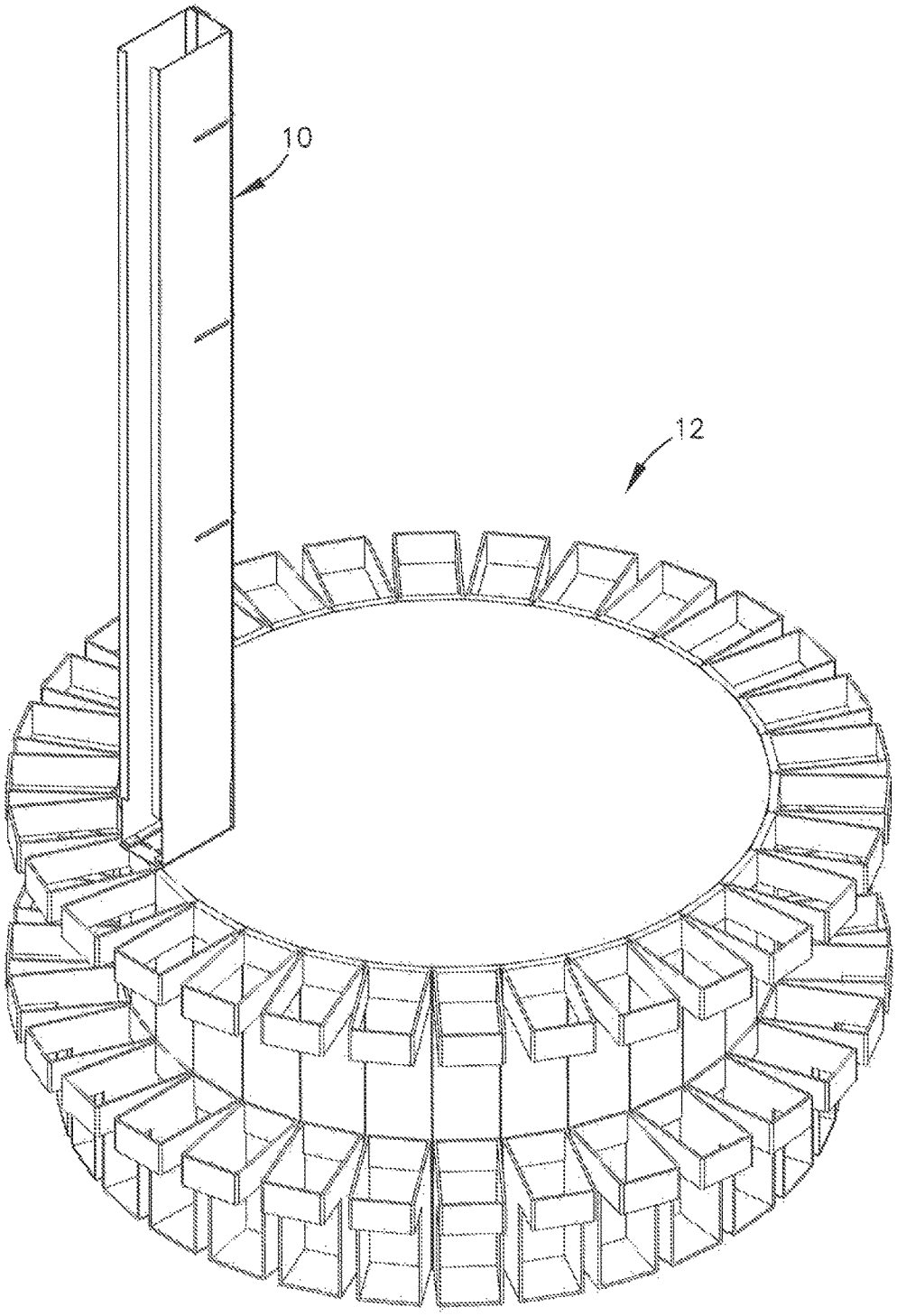
FIG. 2 is an exploded perspective view similar to FIG. 1 showing the sleeve installation path into the dispensing system.
Figure 3:
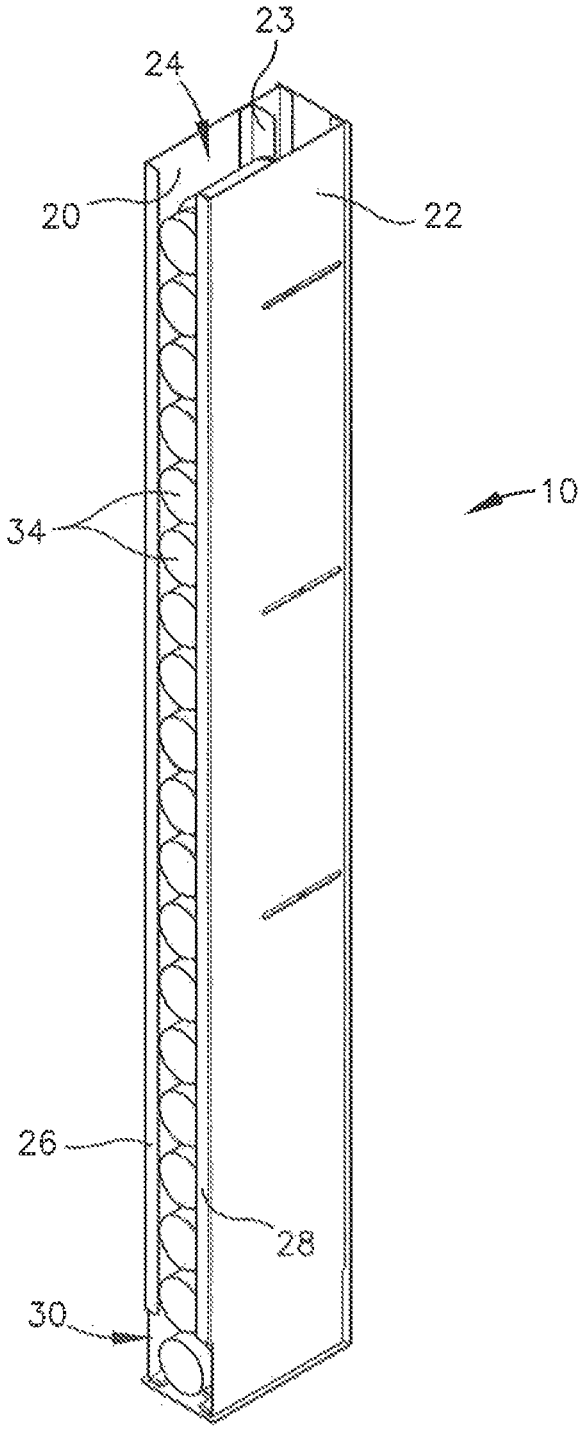
FIG. 3 is a perspective view of an adjustable sleeve with the follower adjusted to position a row of product containers adjacent the front opening.
Figure 6:
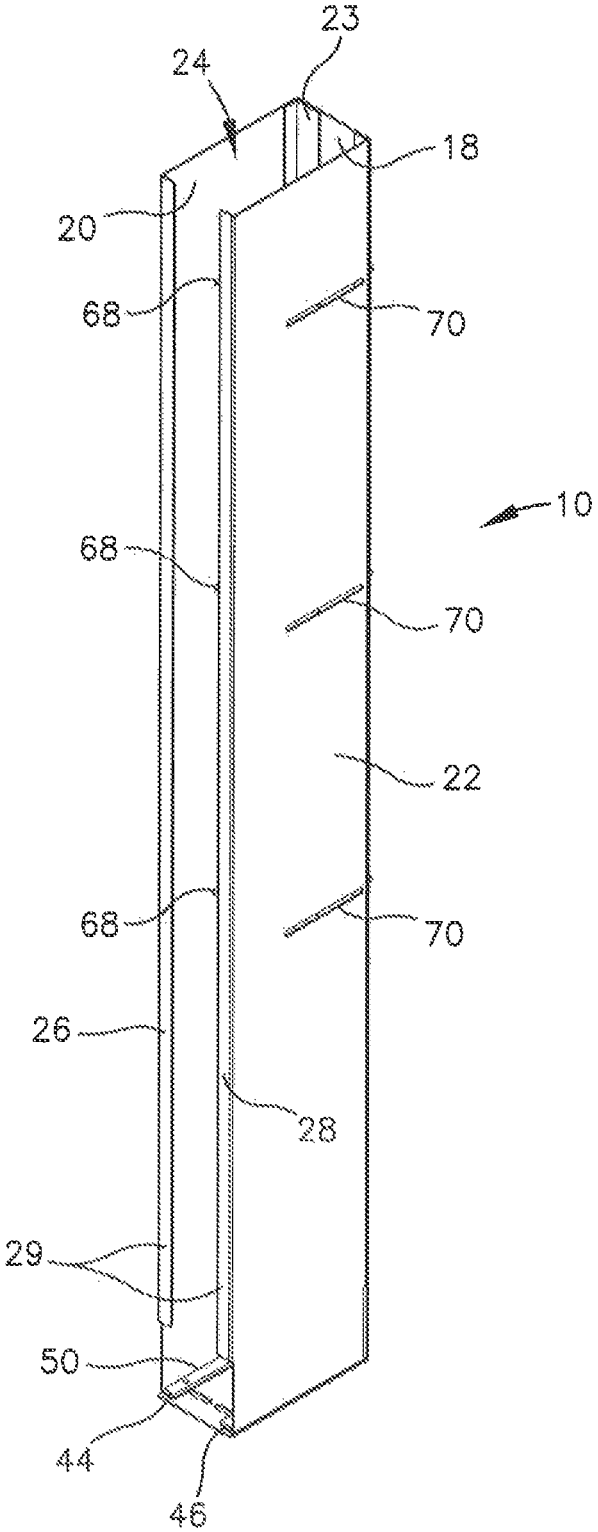
FIG. 6 is a perspective view of an empty adjustable sleeve.
Figure 7:
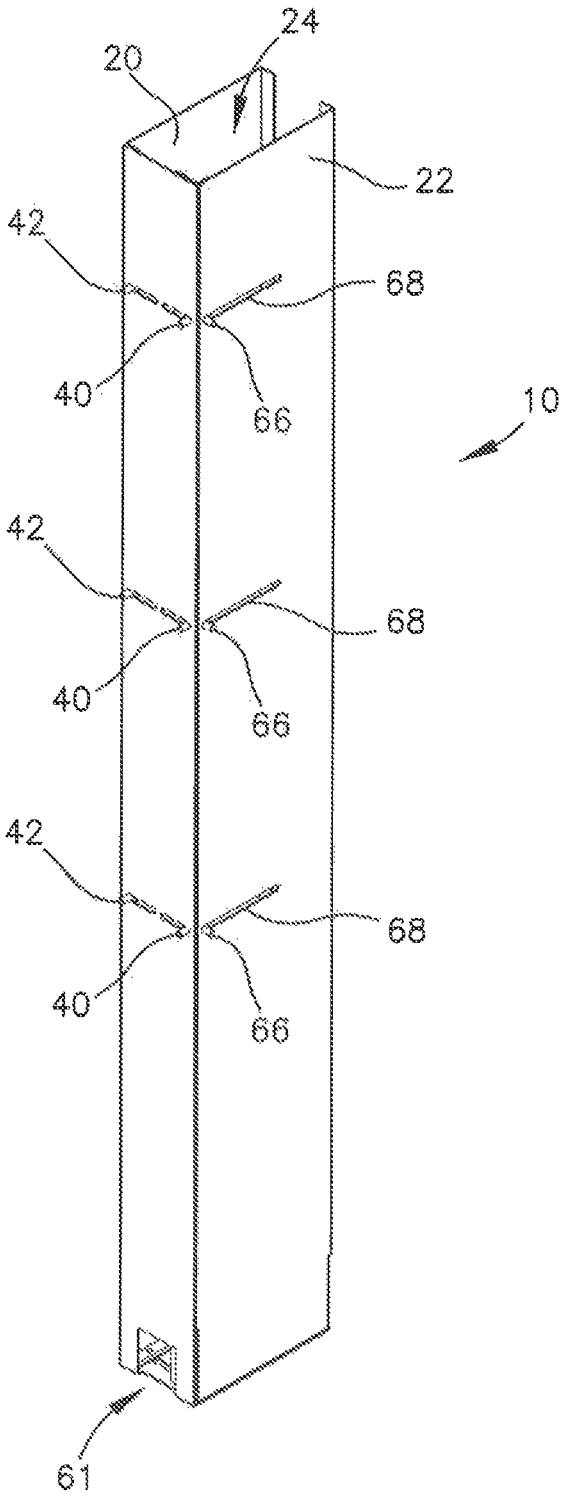
FIG. 7 is a rear perspective view of an empty adjustable sleeve.

Referring now to the drawing figures, the reference numeral 10 refers to an adjustable product magazine sleeve, which is depicted in FIGS. 1 and 2 in association with the carousel portion 12 of a rotary automatic product dispensing unit. While this type of dispensing unit has been selected for illustration, the magazine sleeve 10 may also be employed in association with any other type of automatic or semi-automatic dispensing unit having product magazines, such as a linear dispensing unit, or a dispensing unit having stacked multiple rows, branched rows, or any other suitable arrangement of the magazines. The product magazine sleeve 10 includes a central support 14, shown in FIGS. 8 and 9 to include a base 16 and a back wall 18. The base 16 and back wall 18 may be of unitary construction, as shown, or they may be connected by fasteners. It is also foreseen that the base and back wall may not be connected to each other, but will be remotely coupled when the sleeve 10 is fully assembled as will be described. As shown in FIGS. 3, 6, and 7, the magazine sleeve also includes first and second sidewalls 20 and 22 and a product support rail or follower 23. The central support member 14 and the sidewalls 20 and 22 cooperatively form a product compartment or channel 24. In one embodiment, a pair of product support rails 23 is employed.

The first and second sidewalls 20 and 22 are configured as mirror images, to include respective first and second front flanges 26 and 28 (FIG. 6). The front flanges extend substantially orthogonally from the sidewall top margin and along the sides of each respective sidewall to cooperatively form a product-retaining face frame 29 for the sleeve 10. The front flanges 26 and 28 are disposed to terminate at a preselected spaced distance above the connection of the sidewall with the base 16. In this manner, the lower ends of the sidewalls 20 and 22 and the bottom of the face frame 29 are left open, to provide an exit port 30 for the products 34 to be discharged from the magazine sleeve 10. The front flanges 26 and 28 are sized to leave an opening or slot 32, through which an RFID or indicia on one side or end of each of the products 34 (FIG. 3) may be scanned or read.

The sidewalls 20 and 22 include respective first and second back or rear flanges 36 and 38 which extend substantially orthogonally from the sidewall upper margin and in the same direction as the front flanges 26 and 28. The rear flanges 36 and 38 are also disposed to terminate at a preselected spaced distance above the connection of the sidewall 20 and 22 with the base 16 to provide space for making the connection to the base as will be described. While the front flanges 26 and 28 and the rear flanges 36 and 38 are shown in the drawing figures as terminating approximately the same distance from the base 16, it is foreseen that the front flanges 26 and 28 may extend away from the sidewalls 20 and 22 to a greater or lesser distance than the rear flanges 36 and 38 extend from the back wall, depending on the desired width of the face frame 29, the size of the product exit port 30, and the space required for connecting the rear flanges 36 and 38 to the base 16. The rear flanges 36 and 38 include a plurality of first and second spaced projecting integral fastener members 40 and 42, such as welded threaded pins or posts with securing devices 43, such as nuts or wing nuts, or any other suitable fasteners or combination of fasteners, for connecting the sidewalls 20 and 22 to the back wall 18. Alternatively, a series of spaced apart apertures may be substituted for reception of loose fasteners such as bolts.

The sidewalls 20 and 22 also include respective first and second bottom flanges 44 and 46 (FIG. 6). The bottom flanges 44 and 46 each include a pair of spaced apertures 48 (FIG. 8) for fastening to respective first and second clamp bars 50 and 52. The clamp bars 50 and 52 are tapped with threaded apertures 54 to receive corresponding threaded fasteners 56. Alternately, the clamp bars may include untapped apertures for receiving fastening bolts or any other suitable fastener. In one embodiment, only a single clamp bar 50 or 52 may be employed. In another embodiment, a single clamp plate may be substituted for the bars 50 and 52 for attachment to both bottom flanges 44 and 46.

As best shown in FIGS. 7-10, the back wall includes a plurality of spaced pairs of generally horizontal first and second slots 58 and 60 arranged in side-by-side generally horizontal relation for receiving and adjustably positioning respective fasteners 40 and 42 of the sidewall rear flanges 36 and 38. The back wall also includes an aperture or ejector port 61 to provide access for an ejector cylinder (not shown) to urge or push the products 34 forward and out of the magazine 10 through the exit port 30.

Figure 10:
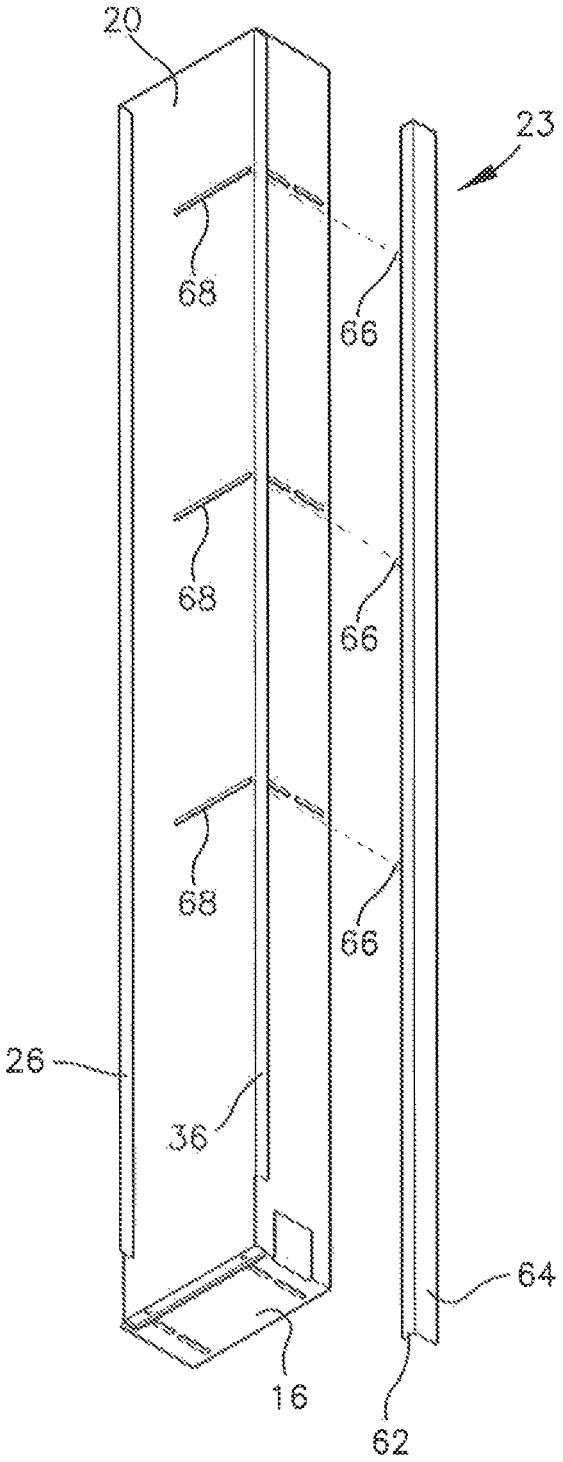
FIG. 10 is an exploded partial view taken from the right front showing details of attachment of the follower.

The follower or adjustable divider 23 (FIG. 10) is elongated and of generally L-shaped construction, including a relatively shorter, sidewall-contacting leg 62 and a longer, rear leg 64, which, when the follower 23 is adjusted, and fastened in place serves as a backstop or stop against rearward movement of the products 34. In one aspect, the follower legs 62 and 64 may be of equal length, or the sidewall-contacting leg 62 may be longer than the rear leg 64. The follower also includes one or a plurality of integral fasteners 66, such as a threaded post. Alternately, the follower 23 may be apertured for attachment by one or a plurality of bolts or similar fasteners. As shown in FIGS. 6 and 10, the sidewalls 20 and 22 each include a respective one or a plurality of generally horizontal spaced apart slots 68 and 70 for receiving and adjustably positioning the follower fasteners 66.

The base 16 (FIG. 8) includes front and rear pairs of slots 72 and 74, and 76 and 78, each pair arranged in side-by-side relation for receiving and adjustably positioning the bottom sidewall flange fasteners 80. The base may also include a central aperture or sensor port (not shown) for providing access to a sensor device such as a retroreflective sensor or any other suitable sensor means for sensing whether or not the product channel 24 is empty of products.

Figure 8:
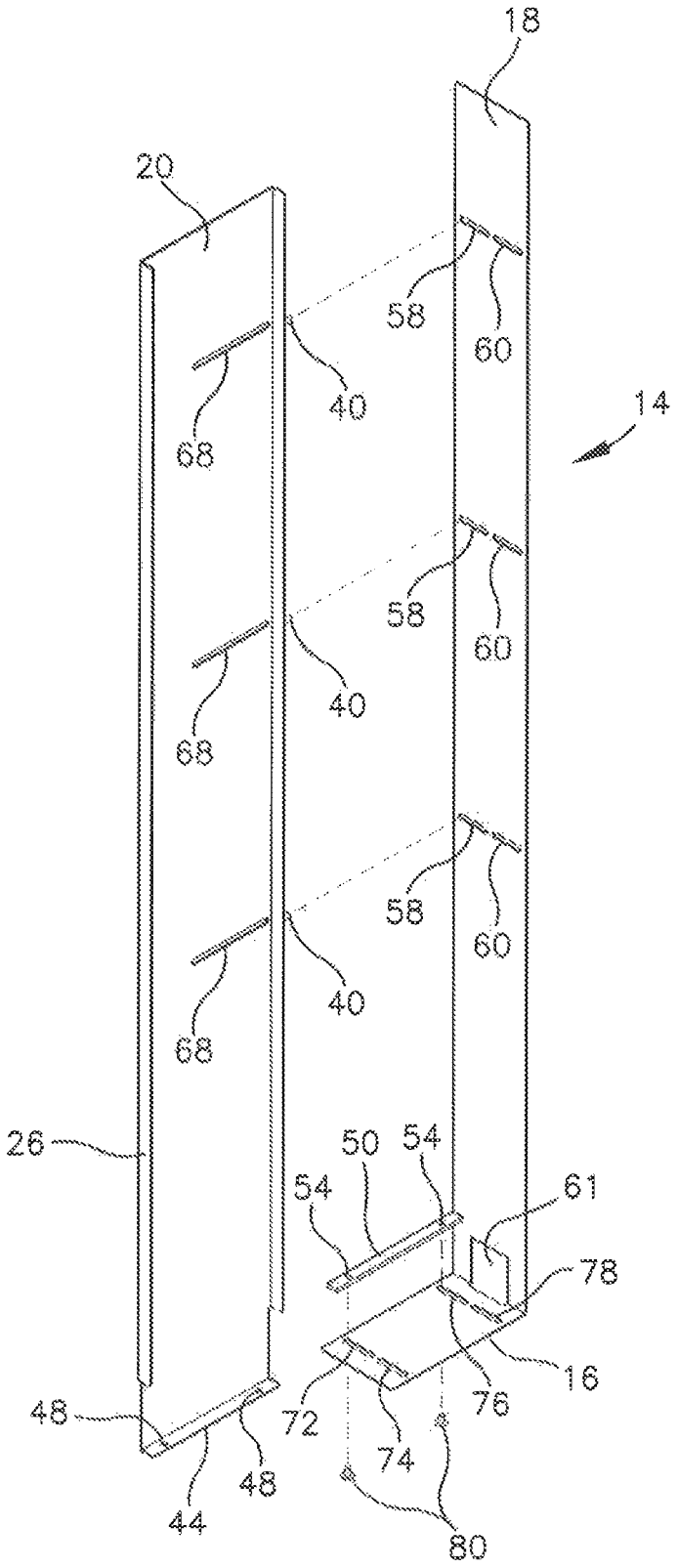
FIG. 8 is an exploded partial view taken from the right front.
Figure 9:
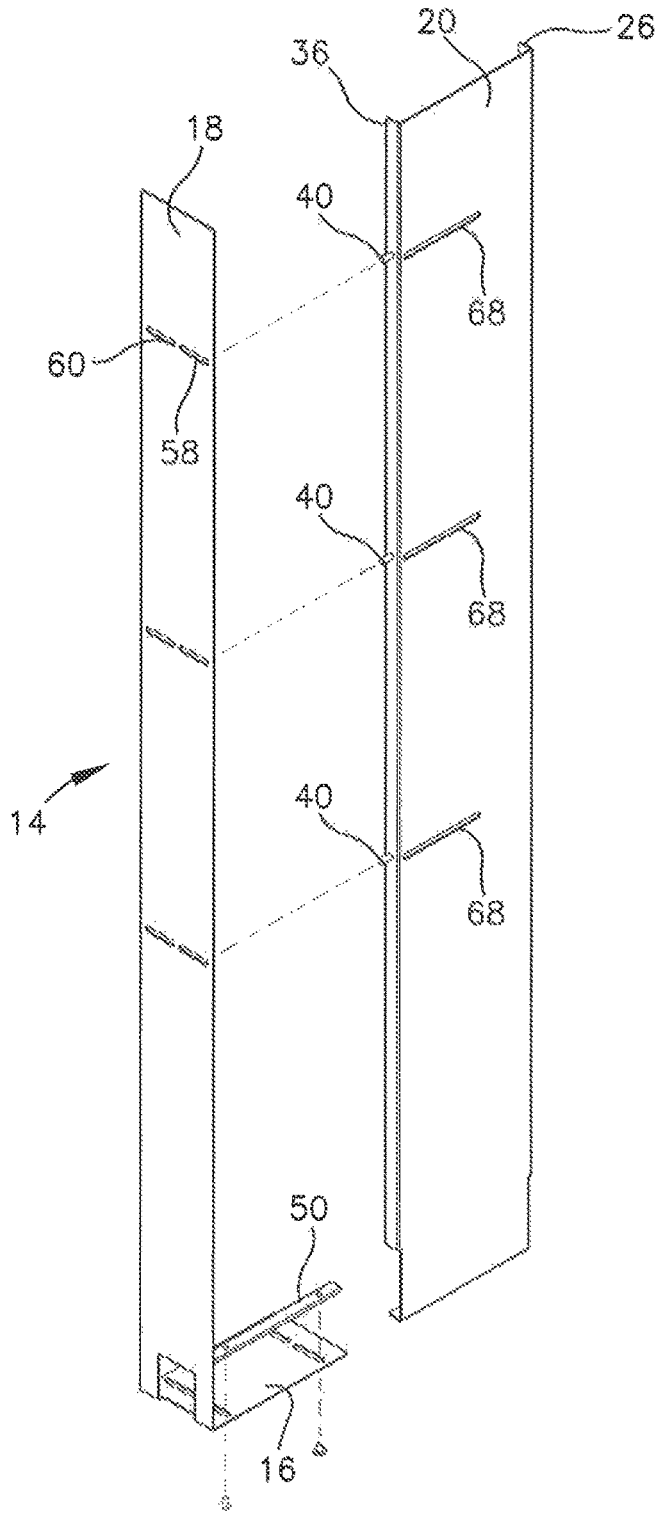
FIG. 9 is an exploded partial view taken from the right rear.

In use, an operator assembles an adjustable product sleeve 10 by aligning each of the central support member base slots 72, 76 or 74, 78 with a corresponding aperture 48 in one of the sidewall bottom flanges 44 or 46 as well as a corresponding aperture 54 in one of the clamp bars 50 and 52 (FIG. 8). The operator also aligns the sidewall rear flange fasteners 40 or 42 with respective back wall slots 58 or 60 (FIG. 9). Once all of the parts are aligned, the operator inserts a fastener 80, which may be a low profile fastener, such as a button head screw, or any other suitable fastener, through a base slot, then a respective sidewall bottom flange, and into a threaded aperture 54 of the clamp bar. The operator next installs a fastener such as a nut or wing nut 43 over each of the fasteners 40 projecting through slots 58 or 60. The fastener 80 and nut 43 are loosely fastened to permit sliding movement of the fasteners 80 and 40 laterally from side-to-side within the respective slots 58, and 72 and 76 to position the sidewall 20 or the fasteners 80 and 42 within the respective slots 60 and 74, 78 to move the respective sidewalls 20 and 22 toward and away from each other, thereby adjusting the width of the product compartment 24. A product follower 23 is installed by aligning the follower fasteners 66 with the sidewall slots 68 or 70 and loosely fastening fasteners such nuts or wing nuts 43 over the fasteners 66 projecting through the slots 68 or 70. The remaining sidewall 22 or 22 and optional second follower 23 may be installed in a similar manner.

Figure 5:
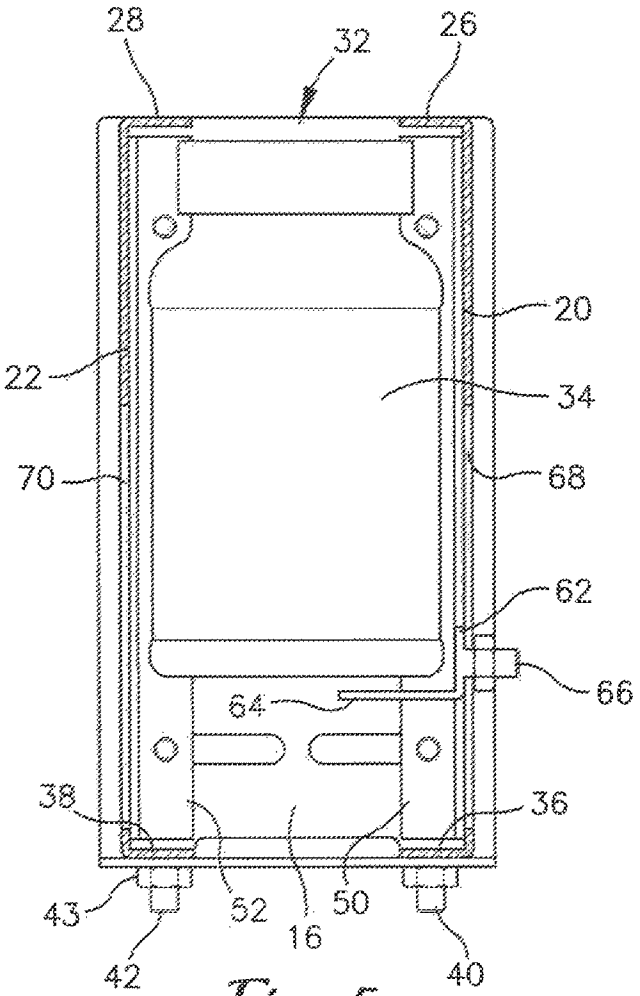
FIG. 5 is a top plan view similar to FIG. 4 with the sleeve adjusted for a larger container.
Figure 4:
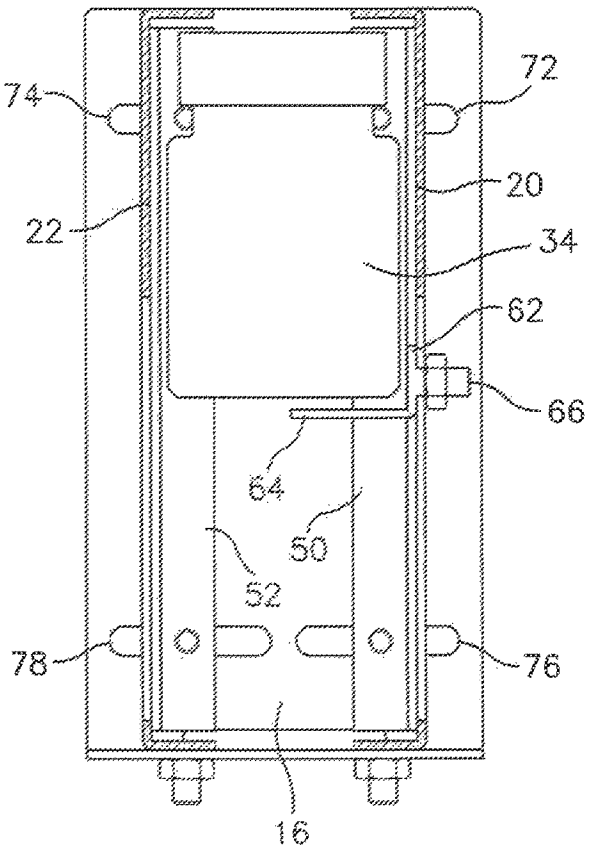
FIG. 4 is a top plan view of the sleeve adjusted for a small container.

The operator adjusts the position of the first sidewall 20 laterally with regard to the central support member 14 by sliding the fasteners 80 within the base slots 72 and 76 and the rear flange fasteners 40 within the back wall slots 58. The position of the second sidewall 22 is laterally adjusted in the same manner by sliding the fasteners 80 within the base slots 74 ad 78 and the rear flange fasteners 42 within the back wall slots 60. The sidewalls 20 and 22 are adjusted laterally toward and away from each other until they are positioned to comfortably accommodate the width of the product 34 while maintaining it in a desired orientation (FIGS. 4, 5). Alternatively, a selected sidewall 20 or 22 may be positioned and tightened in a preselected location and the other sidewall 22 or 20 may be adjusted laterally to achieve the desired spacing between the sidewalls 20 and 22. The fasteners 80 are tightened to snug the clamp bars 50 against the bottom flanges 44 and 46 and the base 16 and the nuts 43 are tightened to hold the rear flanges 36 and 38 against the back wall 18, thereby removably fixing and retaining the overall configuration of the sleeve 10. The follower or followers 23 are adjusted forwardly toward the face frame 29 and front opening 32 by sliding the fasteners 66 within the slots 68 and 70 until they are positioned to comfortably accommodate the length of the product 34 while maintaining it in a desired orientation (FIGS. 4, 5). In this manner the structure of the product magazine sleeve 10 may be adjusted and readjusted to enlarge or contract the size of the product compartment 24 as shown in FIGS. 4 and 5 to accommodate larger or smaller products 34, which may be wider, narrower, longer or shorter, or the shape of irregularly shaped products 34 to be dispensed.

The product sleeve 10 is then ready for installation in an automated product dispensing device. The sleeve 10 may be preloaded with a quantity of a selected product before installation into the dispensing device, or it may be installed empty and filled prior to dispensing. As shown in FIGS. 1 and 2, the product magazine sleeve 10 is easily removable from the dispensing system 12. The size of the product compartment 24 may be adjusted as previously described to accommodate larger or smaller products and may be refilled with a quantity of products or left empty. The sleeve 10 may be easily reinstalled in the dispensing system 12 for use and/or reuse. It is also foreseen that any other removable product magazine sleeves may be employed in the dispensing system 12, such as non-adjustable product magazine sleeves.

In one embodiment, the sidewalls 20 and 22 are adjusted approximately equally so that the front opening 32 will be generally positioned in the middle of the front of product 34. In another embodiment, in which centering of the products within the front opening 32 is not required, a single one of the sidewalls 20 or 22 may be adjusted, or both sidewalls may be adjusted unequally to form an opening 32 in which the product 34 is not centered.

Those skilled in the art will appreciate that a single adjustment slot may be substituted for the previously described pairs of slots. For example, the back wall slots 58 and 60, the base slot pairs 72, 74 and 76, 78 could each be configured as a single slot with the sidewall bottom flange attachments modified accordingly. Similarly, a single slot may be substituted for the previously described pluralities of slots. For example, the sidewall slots 68 and 70 could each comprise a single slot and the base pairs 72, 74 and 76, 78 could comprise a single slot. A series of spaced apertures or holes may also be substituted for each slot. The fasteners may be threaded or flighted, and pins, snap or spring loaded fasteners may also be employed.

The assembled and adjusted product magazine sleeve 10 may be preloaded with a selected product and installed on an automatic dispensing unit. The identity of the products 34 may be determined by using a scanning device to read an RFID, or bar coding or other indicia on the sides of the products 34 from the open top of the product compartment 24 (FIG. 3) or through a window (not shown) in one or both of the sidewalls 20 and 22 or through an aperture (not shown) in the base 16. Product identity may also be determined by scanning or reading the ends of the products through the exit port 30 or the ejector port 61. In this manner, the identity of the product loaded into the sleeve may be verified and compared with coding or indicia installed on the automatic dispensing unit and order data via a control unit.

Advantageously, the size of the product channel 24 may be repeatedly enlarged and contracted or adjusted and readjusted by shifting the sidewalls 20 and 22 toward and away from each other to modify the width of the channel and by moving the follower or followers 23 forward or backward to modify the length of the channel 24 in order to accommodate a wide variety of product sizes and shapes.

It is to be understood that, while certain forms of the adjustable product magazine sleeve have been illustrated and described herein, the invention as defined by the appended claims and their equivalents is not to be limited to the specific forms or arrangement of parts described and shown.

The following is claimed and desired to be secured by Letters Patent:

1. An adjustable product magazine for a product dispensing system, comprising:

a. a back wall connected to a base;

b. first and second sidewalls, each including a front flange, a back flange and a bottom flange;

c. the base having a substantially transverse slot for adjustably positioning fasteners that connect the sidewall bottom flanges to the base;

d. the back wall having a substantially transverse slot for adjustably positioning fasteners that connect the sidewall back flanges to the back wall;

e. a follower member; and f. at least one of the sidewalls having a substantially transverse slot for adjustably positioning a fastener connecting the follower to said one of the sidewalls.

2. The adjustable product magazine of claim 1, further including a clamp member for fastening one of the sidewall bottom flanges to the base.

3. The adjustable product magazine of claim 1, wherein the back wall includes an aperture for receiving a product ejector.

4. The adjustable product magazine of claim 1, wherein the sidewall back flanges each include a fastener.

5. The adjustable product magazine of claim 2, including:

a. a pair of clamp members for removably fastening each of the sidewall bottom flanges to the base.

6. The adjustable product magazine of claim 1, wherein the follower includes an integral fastener member.

7. An adjustable product magazine for a product dispensing system, comprising:

a. a central support member having a back wall and a base;

b. first and second sidewalls;

c. a product follower member;

d. a pair of clamp members;

e. the central support member and first and second sidewalls cooperatively defining a product compartment;

f. the sidewalls each including a front flange, a back flange and a bottom flange;

g. the front flanges terminate in spaced relation to the base to provide a product exit port;

h. the central support back wall has substantially transverse spaced apart slots for adjustably positioning fasteners that connect the sidewall rear flanges to the back wall;

i. the base has substantially transverse spaced apart slots for adjustably positioning fasteners that connect the sidewall bottom flanges to the base and to the clamp members; and j. the sidewalls include substantially transverse slots for adjustably positioning fasteners connecting the follower to one of the sidewalls.

8. A method of adjustably positioning products in an adjustable product magazine for a product dispensing system, the method comprising:

a. providing an adjustable product magazine for a product dispensing system, the magazine comprising a central support member having a back wall and a base; first and second sidewalls; a product follower member; a pair of clamp members; the central support member and first and second sidewalls cooperatively defining a product compartment; the sidewalls each including a front flange, a back flange and a bottom flange; the front flanges terminate in spaced relation to the base to provide a product exit port; the central support back wall has substantially transverse spaced apart slots for adjustably positioning fasteners that connect the sidewall rear flanges to the back wall; the base has substantially transverse spaced apart slots for adjustably positioning fasteners that connect the sidewall bottom flanges to the base and to the clamp members; and the sidewalls include substantially transverse slots for adjustably positioning fasteners connecting the follower to one of the sidewalls;

b. positioning a fastener through one of the base slots to connect the first sidewall bottom flange to the base and to a clamp member;

c. positioning a fastener through one of the base slots to connect the second sidewall bottom flange to the base and to a clamp member;

d. positioning a fastener through one of the back wall slots to connect the first sidewall back flange to the back wall;

e. positioning a fastener through one of the back wall slots to connect the second sidewall back flange to the back wall;

f. positioning a fastener connecting the follower through one of the sidewall slots to connect the follower to one of the sidewalls;

g. moving the sidewalls to a selected spaced apart position by sliding the fasteners in the base and back wall slots and securing the fasteners, the central support member back wall and base and the first and second sidewalls to form a product compartment;

h. loading a plurality of products into the compartment; and i. sliding the follower fastener in the sidewall slots to move the follower to a selected position adjacent the product.

9. A method of adjustably positioning products in an adjustable product magazine for a product dispensing system, the method comprising:

a. providing an adjustable product magazine for a product dispensing system, the magazine comprising a back wall connected to a base; first and second sidewalls, each including a front flange, a back flange and a bottom flange; the base having a substantially transverse slot for adjustably positioning fasteners that connect the sidewall bottom flanges to the base; the back wall having a substantially transverse slot for adjustably positioning fasters that connect the sidewall back flanges to the back wall; a follower member; and at least one of the sidewalls having a substantially transverse slot for adjustably positioning a fastener connecting the follower to said one of the sidewalls;

b. positioning a fastener through the base slot to connect the first sidewall bottom flange to the base;

c. positioning a fastener through the base slot to connect the second sidewall bottom flange to the base;

d. positioning a fastener through the back wall slot to connect the first sidewall back flange to the back wall;

e. positioning a fastener through the back wall slot to connect the second sidewall back flange to the back wall;

f. positioning a fastener connecting the follower through the sidewall slot to connect the follower to the sidewall;

g. moving the sidewalls to a selected spaced apart position by sliding the fasteners in the base and back wall slots and securing the fasteners, back wall and base and the first and second sidewalls to form a product compartment;

h. loading a plurality of products into the compartment; and i. sliding the follower fastener in the sidewall slot to move the follower to a selected position adjacent the product.

* * * * *